United States Patent [19]

Matsushiro

[11] 4,320,441

[45] Mar. 16, 1982

[54] RETRACTABLE HEADLIGHTS FOR RADIO-CONTROLLED TOY VEHICLES

[75] Inventor: Yukimitsu Matsushiro, Tokyo, Japan

[73] Assignee: K.K. Matsushiro, Tokyo, Japan

[21] Appl. No.: 197,867

[22] Filed: Oct. 17, 1980

[30] Foreign Application Priority Data

Oct. 19, 1979 [JP] Japan ..... 54-143967[U]

[51] Int. Cl.[3] ..... B60Q 1/06

[52] U.S. Cl. ..... 362/65; 362/69; 362/70

[58] Field of Search ..... 362/65, 66, 69, 70

[56] References Cited

U.S. PATENT DOCUMENTS

| | | | |
|---|---|---|---|
| 2,284,538 | 5/1942 | Parkes | 362/65 |
| 3,532,872 | 10/1970 | Hall | 362/65 |
| 4,246,628 | 1/1981 | Hcemizu | 362/65 |

*Primary Examiner*—Donald P. Walsh
*Attorney, Agent, or Firm*—Ladas & Parry

[57] ABSTRACT

A retractable headlight for radio-controlled toy vehicles which is provided with a cam mechanism that raises and retracts said headlight in resistance to a resilient means in accordance with rotation of a motor, which is controlled only on and off by a channel with a single signal wave is disclosed.

6 Claims, 4 Drawing Figures

RETRACTABLE HEADLIGHTS FOR RADIO-CONTROLLED TOY VEHICLES

TECHNICAL FIELD OF THE INVENTION

This invention relates to retractable headlights for radio-controlled toy vehicles, especially automobiles.

BACKGROUND OF THE INVENTION

Automobiles with retractable headlights have been on the market for many years. On the other hand, in the hitherto known radio-controlled toy vehicles, only forward and backward movement and steering are regulated by the so-called two channel control. (Conventionally one channel comprises two signal waves.) It would be quite easy to make the headlight of a toy auto retractable by adding one control channel. But such a toy auto with retractable headlights does not yet appear until today.

The reason therefor probably is that another motor is required even for moving the headlights, a considerable space is necessary and the mechanism for smoothly raising and retracting the headlights is more difficult to design than it first anticipated.

I have been engaged in the designing of mechanisms for raising and retracting the headlights of toy autos by means of radio control. The principle is quite easy, that is, it is all right, if the rotational movement of a motor shaft is converted into a motion to turn up and turn down the headlights. But it was more difficult than imagined to design a mechanism that functions smoothly and that is robust enough to withstand the use as a toy.

For that purpose, it was thought that two cams were necessary, one for converting the rotation of a motor to partial reversible rotation of a shaft and the other for converting the partial reversible rotation of said shaft to a motion for raising and retracting a headlight. And if both the raising movement and retracting movement were to be effected by means of cam mechanism, frictional resistance increased and such a cam mechanism did not function smoothly. If a headlight in the raised position with such a cam mechanism was subjected to impact, the mechanism lacked buffer function and therefore was easily broken. Thus I could not succeed in creating a commercially acceptable product.

I dismissed the idea to provide a mechanism to stop the headlight in its raised position, and adopted an idea to control a motor only on and off with a pushbutton switch by means of a single signal wave, whereby the motor simply continues to rotate while in the on state and is at rest in the off state, to employ a cam of the shape which enables the headlight to remain for a longer time at the most raised position and the most retracted position in comparison with the moving periods, so that the operator can manually turn the switch off during the period when the headlight is raised or retracted. Further the headlight is supported by a resilient means so that it is normally kept in the raised position and is retracted by the action of the cam. Thus the headlight is not only very smoothly raised and retracted but also it can be automatically retracted in resistance to said resilient means even if external force is applied thereto while it is in the raised position, and thus breakage is avoided. In this way I have completed this invention.

DISCLOSURE OF THE INVENTION

This invention provides a retractable headlight for radio controlled toy vehicles which is provided with a cam mechanism that raises and retracts said headlight in accordance with the rotation of a motor, which is operated with a transmitter and a receiver by a single signal wave, said motor continuing rotation in the on state of a push button switch of the transmitter, said cam having a shape that enables the headlight to take time at the most raised position and at the most retracted position, to give the operator time enough to turn the switch off while the headlight stays in the raised position or in the retracted position.

In the more preferred embodiment of this invention, a retractable headlight for the radio-controlled toy vehicle as described above wherein the body of the headlight is provided with a hook means extending therefrom, which is pulled with a resilient means so as to raise the headlight with a shaft (pins) as a fulcrum; a lever arm which is secured to a shaft and the end of which engages with a rear part of the bottom of the headlight body, said shaft rotating in accordance with the rotation of a cam which is rotated by a motor through a gear system; whereby when said lever turns in one direction the headlight body is raised by means of said resilient means, and when said lever turns in the other direction, the headlight body is retracted in resistance to the restoring force of said resilient means.

The principle of the combination of a resilient means and a cam counteracting the former is conventional. But still inventive genius is required for applying the principle to a practical mechanism. In the case of this invention, the employment of this principle simultaneously achieved two effects—a smooth retracting movement and the buffer function against external force, in combination with the employment of a shaft which is simply rotated or rests. This has brought about a commercially successful toy auto. This fact should be evaluated.

Now the invention is described in detail with reference to the attached drawings with respect to a preferred embodiment.

BRIEF DESCRIPTION OF THE ATTACHED DRAWINGS

Figure 1:
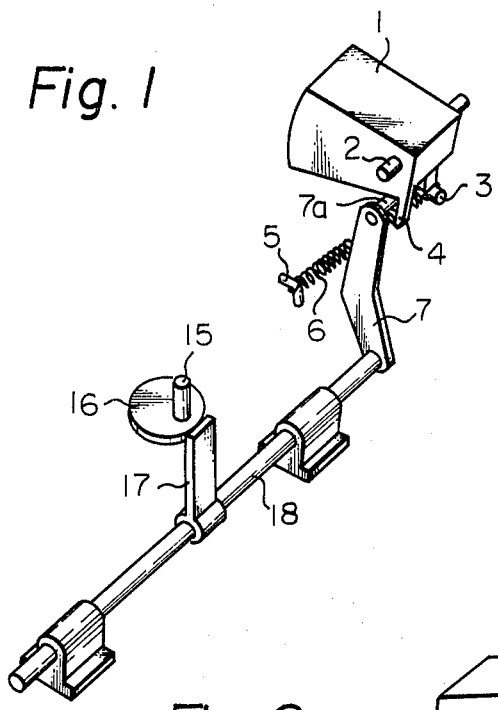
FIG. 1 is a perspective of a retractable headlight in accordance with this invention viewed from the left rear, which shows the headlight in the most raised position.

In FIG. 1, a headlight body (1) is supported on a car body, which is not shown, rotatably around pins (2). The headlight body (1) is provided with a lever arm (4) and a hook (3) at the rear bottom thereof. A coil spring (6) is stretched between another hook (5) fixed to the car body and the hook (3) of the headlight body so that the headlight body is kept in the raised position.

The lever arm (4) engages with a pin (*7a*) secured to a lever arm (7), which is in turn secured to a driving shaft (18). The driving shaft (18) is supported by bearings secured to the car body and is provided with another lever arm (17) secured thereto approximately at the center thereof. This lever arm (17) contacts a cam (16) having an eccentric shaft (15). On the left side of the rotation shaft (18), a left side headlight body is provided in the same manner, but it is not shown.

Figure 2:
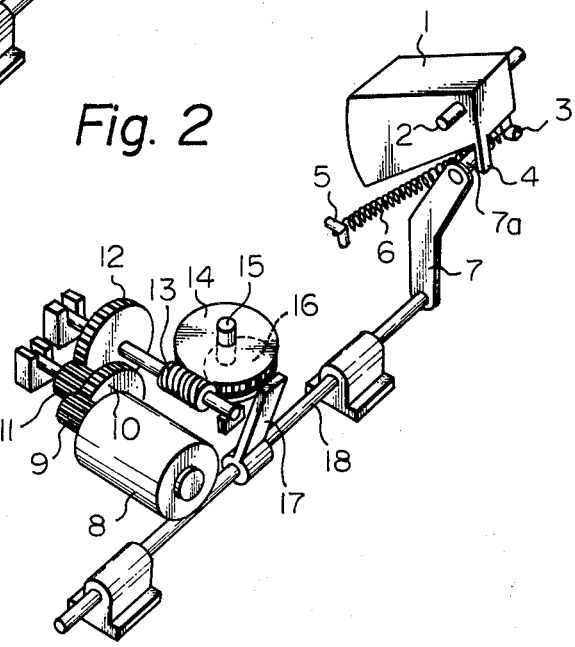
FIG. 2 is a perspective of the retractable headlight shown in FIG. 1 viewed from the left rear, which shows the headlight at the most retracted position and the driving motor and the gear system.

As shown in FIG. 2, the shaft (15) of the cam (16) is provided with gear (14), and said cam is rotated by a motor (8) through gears (9), (10), (11), (12), a worm gear (13) and the above-mentioned gear (14).

When the second lever arm (17) contacts the short radius part of said cam (16), the headlight is in the raised position as shown in FIG. 1, and when said arm contacts the long radius part of said cam, the headlight is in the retracted position as shown in FIG. 2. When the first lever (7) moves forward (rotates anti-clockwise in FIG. 1), the pin (7*a*) of the lever arm (7) which engages with the lever arm (4) of the headlight body allows the upward rotation of the headlight body (1) pulled by the coil spring (6), and thus the headlight body is raised. When the second arm (17) contacts the long radius part of the cam (16) and leans backward (in FIG. 2), the shaft (18) and thus the first lever arm (7) rotates backward (clockwise in the figures), and the pin (7*a*) pushes the lever arm (4) of the headlight body (1) backward as slightly slipping, said movement retracting the headlight body.

The second lever arm (17) of the shaft (18) is always in contact with the cam (16) by virtue of the tension of the coil spring (6) which is transmitted to said lever by way of the first lever (7) and the shaft (18). Therefore, when the motor (8) continues to rotate, the second lever (17) which contacts the cam (16) repeats the forward and backward leaning motions, and therefore the headlight body repeats the retracting and rising motions.

When the headlight body is in the most raised position as shown in FIG. 1, if external force is applied to the headlight body, the headlight body is freely retractable rotating round the pins (2). The external force is absorbed by stretching of the coil spring (6), and breakage is avoided.

It is desirable that the shape of the cam (16) is such that when the headlight body is in the most raised or the most retracted position, it can maintain that position for a short while. Because the motor (8) continues to rotate as long as the switch of the transmitter is in the on state and the headlight continues its rising and retracting motions endlessly unless the operator releases the push button to turn the switch off. If the period in which the headlight stays in the raised position is short, the operator must be extremely careful to catch the moment to release the push button switch, and interest as a toy is lost.

Even in the radio control of the raising and retracting of a headlight, the raising and retracting motions can be controlled by two separate signal waves as in the steering. But it will require circuits to transmit two additional modified signal waves in the transmitter and a stopping mechanism and space therefor in the toy vehicle. It is one of the reasons why I succeeded in creation of the radio control toy automobile with retractable headlights is that I discarded the idea of using the two signal waves and a stopping mechanism and employed the simple on-off operation of a motor by means of a single signal wave and left the stopping of the raising or retracting motion to release of the switch button by the operator.

Figure 3:
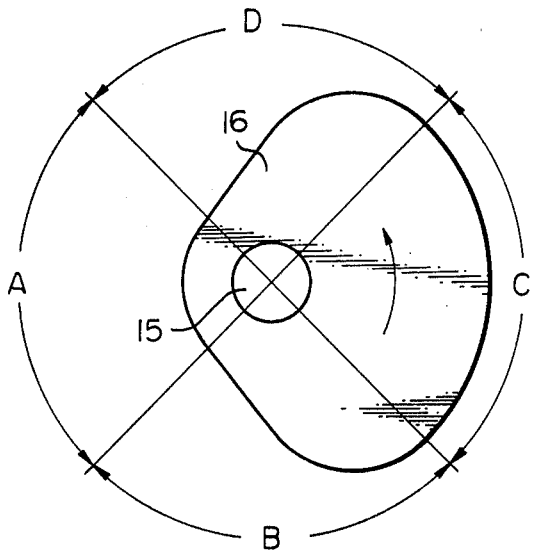
FIG. 3 is a schematic presentation of the conception of the cam used in this invention.

The conception of the shape of the cam is shown in FIG. 3. The cam (16) rotates round the shaft (15) in the arrow direction. The sector A is the short radius part. When the second lever (17) contacts this part and thus the first lever (7) stands upright or leans forward, the headlight is in the raised position. (Refer to FIG. 1.)

The sector B is a part in which the radius changes from short to long. When the second lever (17) contacts this part, the headlight gradually turns from the most raised position toward the retracted position.

The sector C is the long radius part. When the second lever (17) contacts this part, said lever and thus the first lever (7) leans backward and the headlight is in the retracted position. (Refer to FIG. 2.)

The sector D is a part in which the radius changes from long to short. When the second lever (17) contacts this part, the headlight is gradually raised.

Thus, as the cam continues to rotate, the headlight repeats the rising and retracting motions endlessly. By properly designing the shape of the cam, it is possible to make the headlight to stay longer in the raised and the retracted positions during which time the operator can release the push button switch.

Although the invention has been explained in detail with respect to a preferred embodiment, various modifications are possible.

Figure 4:
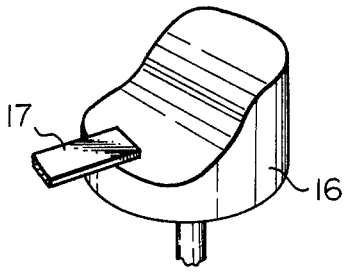
FIG. 4 is a perspective of another embodiment of said cam.

One of the variations of the shape of the cam (16) is shown in FIG. 4. In this embodiment, the cam is a cylindrical body with a flat bottom and an upper surface which undulates from a lower level to higher level. When the lever (17) contacts the lower level part, the headlight is raised; and when the lever contacts the higher level part, the headlight is retracted. By making the length of the transition parts as short as possible, that is, as steep as possible, one can make the level parts the longest.

In the above described embodiment, the headlight body is provided with a hook (3) and a lever arm (4) separately. But of course one member can perform the two functions.

The above are only a few examples of modifications. It will be understood that various other variations are possible in working this invention.

INDUSTRIAL APPLICABILITY

It is apparent that this invention is easily adopted in toy making and will usher in a new phase to the toy industry, especially to the manufacturing of radio controlled toy vehicles.

I claim:

1. A retractable headlight apparatus for a radio controlled toy vehicle, comprising a headlight body, means for supporting the headlight body so as to be movable between a raised position and a retracted position, a motor having an output shaft and having an "on" condition in which the output shaft rotates continuously in the same direction and an "off" condition in which the output shaft does not rotate, a cam member which has a endless cam track and is drivingly connected to said output shaft to be rotated continuously in the same direction when the motor is in the "on" condition, and a cam follower which engages said cam track to be moved thereby upon rotation of the cam member and is drivingly connected to said headlight body for moving it continuously between said positions when the motor is in its "on" condition, said cam track having a first drive portion which, when engaged by the cam follower with the motor in the "on" condition, causes the headlight body to be moved towards its raised position, a first dwell portion which, when engaged by the cam follower with the motor in the "on" condition, causes the headlight body to remain in its raised position, a second drive portion which, when engaged by the cam follower with the motor in the "on" condition, causes the headlight body to be moved towards its retracted position, and a second dwell portion which, when engaged by the cam follower with the motor in the "on" condition, causes the headlight body to remain in its retracted position, the cam track being shaped so that during rotation of the cam member the cam follower engages each of the dwell portions of the cam track for a period which is substantial in relation to the period for which the cam follower engages each of the drive portions of the cam track.

2. A retractable headlight apparatus as claimed in claim 1, wherein the cam track is shaped so that during rotation of the cam member the cam follower engages each of the dwell portions of the cam track for a period which is substantially equal to the period for which the cam follower engages each of the drive portions of the cam track.

3. A retractable headlight apparatus as claimed in claim 1, wherein the cam member is formed as a plate which is mounted to rotate about a predetermined axis perpendicular to the plate, and the cam track is constituted by the peripheral surface of the plate, each of said portions being of substantially the same angular extent about said predetermined axis.

4. A retractable headlight apparatus as claimed in claim 1, wherein the cam member is a cylindrical member mounted to rotate about its central axis and the cam track is constituted by an annular region of an end face of the cylindrical member.

5. A retractable headlight apparatus as claimed in claim 1, wherein the means for supporting the headlight body comprise pivot means so that the headlight body is pivotable between its raised position and its retracted position, and the cam follower is drivingly connected to the headlight body through a shaft upon which the cam follower is mounted and which is mounted to be rotated by movement of the cam follower, and a lever arm which is secured to the shaft and engages the headlight body to pivot the headlight body from its raised position to its retracted position when the drive shaft is rotated by movement of the cam follower when it engages the first drive portion of the cam track.

6. A retractable headlight apparatus as claimed in claim 5, comprising resilient means connected to the headlight body and urging the headlight body towards its raised position, the cam follower being drivingly disconnected from the headlight body when the cam follower engages the first drive portion of the cam track.

* * * * *